US005922143A

United States Patent [19]

Verin et al.

[11] Patent Number: 5,922,143

[45] Date of Patent: Jul. 13, 1999

[54] PROCESS FOR MANUFACTURING A MAGNETIC CORE MADE OF A NANOCRYSTALLINE SOFT MAGNETIC MATERIAL

[75] Inventors: Philippe Verin; Georges Couderchon, both of Sauvigny les Bois, France

[73] Assignee: Mecagis, Puteaux, France

[21] Appl. No.: 08/957,937

[22] Filed: Oct. 27, 1997

[30] Foreign Application Priority Data

Oct. 25, 1996 [FR] France ..... 96 12996

[51] Int. Cl.[6] ..... H01F 1/147

[52] U.S. Cl. ..... 148/108; 148/121

[58] Field of Search ..... 148/121, 108, 148/122

[56] References Cited

U.S. PATENT DOCUMENTS

| | | | |
|---|---|---|---|
| 5,055,144 | 10/1991 | Fish et al. | 148/403 |
| 5,611,871 | 3/1997 | Yoshizawa et al. | 148/108 |
| 5,725,686 | 3/1998 | Yoshizawa et al. | 148/307 |

FOREIGN PATENT DOCUMENTS

| | | |
|---|---|---|
| 0 527 233 | 2/1993 | European Pat. Off. . |
| 0 612 082 | 8/1994 | European Pat. Off. . |

OTHER PUBLICATIONS

Patent Abstracts of Japan, vol. 017, No. 071 (E–1319), Feb. 12, 1993; JP 04 275411 A (Mitsu Petrochem Ind. Ltd.), Oct. 1, 1992.

Patent Abstracts of Japan, vol. 017, No., 071 (E–1319), Feb. 12, 1993, JP 04 275410 A (Mitsui Petrochem Ind. Ltd.), Oct. 1, 1992.

IEEE Translation Journal on Magnetics in Japan, vol. 9, No. 6, Nov. 1, 1994; pp. 39–46, "Permeability and Alpha–Fe Phase Precipitated in FE–SI–B–CU–NB Amorphous Alloys".

*Primary Examiner*—John Sheehan

*Attorney, Agent, or Firm*—Oblon, Spivak, McClelland, Maier & Neustadt, P.C.

[57] ABSTRACT

Process for manufacturing at least one magnetic core made of an iron-based soft magnetic alloy having a nanocrystalline structure, wherein an amorphous ribbon is manufactured from the magnetic alloy, the annealing temperature Tm which, in the case of the ribbon, leads to maximum magnetic permeability, is determined, at least one core blank is manufactured from the ribbon and at least one core blank is subjected to at least one annealing operation, said annealing being carried out at a temperature T of between Tm+10° C. and Tm+50° C. for a temperature hold time t of between 0.1 and 10 hours so as to cause nanocrystals to form.

10 Claims, No Drawings

PROCESS FOR MANUFACTURING A MAGNETIC CORE MADE OF A NANOCRYSTALLINE SOFT MAGNETIC MATERIAL

FIELD OF THE INVENTION

The present invention relates to nanocrystalline magnetic materials intended, in particular, for the manufacture of magnetic circuits for electrical appliances.

PRIOR ART

Nanocrystalline magnetic materials are well-known and have been described, in particular, in European Patent Applications EP 0,271,657 and EP 0,299,498. These are iron-based alloys containing more than 60 at. % (atom %) of iron, copper, silicon, boron and, optionally, at least one element selected from niobium, tungsten, tantalum, zirconium, hafnium, titanium and molybdenum, which are cast in the form of amorphous ribbons and then subjected to a heat treatment which causes extremely fine crystallization (the crystals are less than 100 nanometers in diameter) to occur. These materials have magnetic properties which are particularly suitable for manufacturing soft magnetic cores for electrical engineering appliances, such as residual current circuit breakers. In particular, they have an excellent magnetic permeability and may have either a broad hysteresis loop ($Br/Bm \geqq 0.5$) or a narrow hysteresis loop ($Br/Bm \leqq 0.3$), Br/Bm being the ratio of the remanent magnetic induction to the maximum magnetic induction. Broad hysteresis loops are obtained when the heat treatment consists of a single annealing operation at a temperature of approximately 500° C. Narrow hysteresis loops are obtained when the heat treatment includes at least one annealing operation under a magnetic field, this annealing operation possibly being the annealing intended to cause nanocrystals to form.

Materials whose hysteresis loop is broad may have a very high magnetic permeability, greater, even, than that of conventional Permalloy-type alloys. This very high magnetic permeability makes them, a priori, particularly suitable for manufacturing magnetic cores for AC-class residual current circuit breakers, i.e. those sensitive to alternating fault currents. However, for such a use to be possible, the magnetic properties of the cores have to be sufficiently reproducible for manufacture in high volume to be satisfactory.

To manufacture magnetic cores for AC-class residual current circuit breakers in high volume, a ribbon of amorphous magnetic alloy capable of acquiring a nanocrystalline structure is used. A series of tori of approximately rectangular cross-section is manufactured by winding a certain length of ribbon around a mandrel and by making a spot weld. The tori thus obtained are then subjected to an annealing operation so as to cause nanocrystals to form and, as a result, to give them the desired magnetic properties. The annealing temperature, which lies in the region of 500° C., is chosen so that the alloy has the maximum magnetic permeability. The magnetic cores thus obtained are intended for receiving coils which generate mechanical stresses which degrade the magnetic properties of the cores. To limit the consequences of the coiling stresses, the tori are placed in protective housings inside which they are wedged, for example by foam washers. However, this wedging of the tori in their housing itself induces small stresses which are prejudicial to the excellent magnetic properties developed on the core. The use of a protective housing, although effective, is not always sufficient and, after coiling, the properties of the devices obtained by industrial manufacture are degraded and too scattered to be still acceptable for the envisaged use.

SUMMARY OF THE INVENTION

The object of the present invention is to remedy these drawbacks by proposing a means for manufacturing, in high volume, magnetic cores made of a nanocrystalline material having both a magnetic permeability (relative permeability for maximum impedance at 50 Hz) greater than 400,000 and a broad hysteresis loop, in such a way that the scatter in their magnetic properties is compatible with the use for manufacture in high volume of AC-class residual current circuit breakers.

The subject of the invention is therefore a process for manufacturing at least one magnetic core made of an iron-based soft magnetic alloy having a nanocrystalline structure, in which:

- an amorphous ribbon is manufactured from the alloy;
- the annealing temperature Tm which, in the case of the ribbon, leads to the maximum magnetic permeability, is determined;
- at least one core blank is manufactured from the ribbon; and
- at least one core blank is subjected to at least one annealing operation carried out at a temperature T of between Tm+10° C. and Tm+50° C., and preferably between Tm+20° C. and Tm+40° C., for a temperature hold time t of between 0.1 and 10 hours, and preferably between 0.5 and 5 hours, so as to cause nanocrystals to form. At least one annealing operation may be carried out under a magnetic filed.

This process applies to all iron-based soft magnetic alloys capable of exhibiting a nanocrystalline structure, and more particularly to those alloys whose chemical composition comprises, in at. %:

$$Fe \geqq 60\%$$

$$0.5\% \leqq Cu \leqq 1.5\%$$

$$5\% \leqq B \leqq 14\%$$

$$5\% \leqq Si+B \leqq 30\%$$

$$2\% \leqq Nb \leqq 4\%$$

The invention will now be described in more detail, but in a non-limiting manner, and will be illustrated by an example.

To manufacture magnetic cores for an AC-class residual current circuit breaker (sensitive to alternating fault currents) in high volume, a ribbon made of a soft magnetic alloy having an amorphous structure is used, this alloy being capable of acquiring a nanocrystalline structure and consisting mainly of iron in a content greater than 60 at. %, and furthermore containing:

- from 0.1 to 3 at. %, and preferably from 0.5 to 1.5 at. %, of copper;
- from 0.1 to 30 at. %, and preferably from 2 to 5 at. %, of at least one element selected from niobium, tungsten, tartalum, zirconium, hafnium, titanium and molybdenum; preferably, the niobium content is between 2 and 4 at. %;
- silicon and boron, the sum of the contents of these elements being between 5 and 30 at. % and preferably between 15 and 25 at. %, it being possible for the boron content to be as high as 25 at. % and preferably being between 5 and 14 at. %, and the silicon content possibly reaching 30 at. %, preferably being between 12 and 17 at. %.

The chemical composition of the alloy may also include small amounts of impurities provided by the raw materials or resulting from the smelting.

The amorphous ribbon is obtained in a manner known per se by very rapid solidification of the liquid alloy. The magnetic-core blanks are also manufactured in a manner known per se by winding the ribbon around a mandrel, cutting it and fixing its end using a spot weld, so as to obtain small tori of rectangular cross-section. The blanks must then be subjected to an annealing treatment in order to make nanocrystals of a size of less than 100 nanometers precipitate in the amorphous matrix. This very fine crystallization makes it possible to obtain the desired magnetic properties and thus to convert the magnetic-core blank into a magnetic core.

As the inventors unexpectedly found that the effect of the annealing conditions on the magnetic properties of the cores depended not only on the chemical composition of the alloy but also, and somewhat uncontrollably, on the particular conditions of manufacture of each ribbon taken individually, the temperature Tm which, for an annealing operation of given duration, leads to the maximum magnetic permeability that it is possible to obtain on a torus manufactured from the ribbon, is determined before carrying out the annealing operation. This temperature Tm is specific to each ribbon and is therefore determined for each ribbon by tests that those skilled in the art know how to carry out.

After having determined the temperature Tm, the annealing is carried out at a temperature T of between Tm+10° C. and Tm+50° C., and preferably between Tm+20° C. and Tm+40° C., for a time of between 0.1 and 10 hours, and preferably between 0.5 and 5 hours.

Temperature and time are two partially equivalent parameters for adjusting the annealing. However, variations in the annealing temperature have a much more marked effect than variations in the duration of the annealing, in particular at the extremes of the permissible annealing-temperature range. Therefore, the temperature is a relatively coarse parameter for adjusting the treatment conditions, the time being a fine adjustment parameter.

The particular conditions of the treatment are determined on the basis of the use envisaged for the magnetic core.

After the heat treatment, each core is placed in a protective housing, in which it is wedged, for example using foam washers. For some applications, each core may be encapsulated in a resin.

Since the annealing temperature is not equal to Tm, the magnetic permeability of the cores is not the maximum. However, the inventors have found that by proceeding in this way it was possible to obtain, sufficiently reliably, a magnetic permeability greater than 400,000. They have also found that the magnetic cores obtained were well-suited to the manufacture of residual current circuit breakers in high volume and that, in particular, they were less sensitive to the effect of coiling stresses.

By way of example on the one hand, and of comparison on the other hand, three batches A, B and C of 200 geometrically identical toric magnetic cores (I.D.=11 mm, O.D.=15 mm, height=10 mm) were manufactured. The three batches were manufactured from the alloy $Fe_{73}Cu_1Nb_3Si_{15}B_8$ (in at. %), cast in the form of an amorphous ribbon 22 $\mu$m in thickness. After manufacturing the magnetic core blanks, the temperature Tm was determined, this being 500° C. for 1 hour. Batch A was annealed at 505° C. (Tm+5° C.) for 1 hour, in accordance with the prior art, batch B was annealed at 530° C. (Tm+30° C.) for 3 hours, according to the invention; and batch C was annealed at 555° C. (Tm+55° C.) for 3 hours, by way of comparison. The average and the standard deviation of the magnetic-permeability values were determined for each of the batches, on the one hand for the bare cores, and on the other hand for the housed cores, i.e. those cores subjected to slight stresses due to the wedging of the torus in its housing. The results of all the measurements were as follows (in the three cases, the Br/Bm ratio was approximately 0.5):

| | Bare core | | Housed core | |
|---|---|---|---|---|
| | Average | Standard deviation | Average | Standard deviation |
| A | 550,000 | 100,000 | 480,000 | 120,000 |
| B | 490,000 | 70,000 | 490,000 | 70,000 |
| C | 360,000 | 70,000 | 360,000 | 70,000 |

These results show that, contrary to what is observed in respect of batch A, the average of the magnetic-permeability values for the cores of batch B is hardly affected by putting the core in a housing and by the stresses which this generates. The same is true for batch C. On the other hand, although the average of the magnetic-permeability values of the housed magnetic cores of batches A and B are similar, the average of the magnetic-permeability values of the housed magnetic cores of batch C is substantially lower.

It may also be seen that the standard deviations of the magnetic-permeability values of the magnetic cores, housed or unhoused, of batches B and C are lower than the standard deviation of the magnetic-permeability values of the magnetic cores, housed or unhoused, of batch A. The difference between batches A and B stems from the fact that the magnetic cores of batch B are less sensitive to the mechanical stresses than the magnetic cores of batch A. The magnetic cores of batch C are, a priori, less sensitive to the mechanical stresses than the magnetic cores of batch B, but they exhibit permeabilities which are incompatible with the application.

As a result of the differences between the averages on the one hand, and the standard deviations on the other hand, approximately 23% of the cores of batch A and approximately 80% of the cores of batch C have a magnetic permeability of less than 400,000, while only 13% of the cores of batch B have a magnetic permeability of less than 400,000.

Moreover, because the scatter in the magnetic properties of the cores of batch B is less than that of the cores of batch A, and because the sensitivity of these properties to the mechanical stresses is less for batch B than for batch A, the magnetic cores of batch B are well suited, after coiling, to use in AC-class residual current circuit breakers, while the cores of batch A are not reliably so. Although being theoretically less sensitive to the mechanical stresses than the cores of batch B, the magnetic cores of batch C, are not suited to use in residual current circuit breakers, in particular because they do not have a sufficiently high magnetic permeability.

For some applications (for example, class-A residual current circuit breakers), it is necessary to use magnetic cores which have narrow hysteresis loops. Such cores may be manufactured by carrying out at least one annealing operation under a magnetic field. The annealing under a magnetic field may be either the annealing which has just been described and which is intended to cause the nanocrystals to precipitate, or an additional annealing operation carried out between 350 and 550° C. The cores thus obtained have, in the same way, a greatly reduced sensitivity to mechanical stresses, thereby increasing the high-volume manufacturing reliability.

We claim:

1. A process for manufacturing at least one magnetic core made of an iron-based soft magnetic alloy, wherein:

an amorphous ribbon is manufactured from the magnetic alloy;

the annealing temperature Tm which, in respect of the ribbon, leads to the maximum magnetic permeability is determined;

at least one core blank is manufactured from the ribbon; and at least one core blank is subjected to at least one annealing operation, the said annealing being carried out at a temperature T of between Tm+10° C. and Tm+50° C. for a temperature hold time t of between 0.1 and 10 hours, so as to form nanocrystals.

2. The process as claimed in claim 1, wherein the temperature hold time is between 0.5 and 5 hours.

3. The process as claimed in claim 1, wherein the annealing temperature T is between Tm+20° C. and Tm+40° C.

4. The process as claimed in claim 1, wherein the chemical composition of the iron-based soft magnetic alloy comprises, in at. %:

$$Fe \geqq 60\%$$

$$0.1\% \leqq Cu \leqq 3\%$$

$$0\% \leqq B \leqq 25\%$$

$$0\% \leqq Si \leqq 30\%$$

at least one element selected from niobium, tungsten, tantalum, zirconium, hafnium, titanium and molybdenum with contents of between 0.1% and 30%, the balance being impurities resulting from the smelting and the composition furthermore satisfying the relationship:

$$5\% \leqq Si+B \leqq 30\%$$

.

5. The process as claimed in claim 4, wherein the chemical composition of the iron-based soft magnetic alloy is such that:

$$15\% \leqq Si+B \leqq 25\%$$

.

6. The process as claimed in claim 4, wherein the chemical composition of the iron-based soft magnetic alloy is such that:

$$0.5\% \leqq Cu \leqq 1.5\%$$

.

7. The process as claimed in claim 4, wherein the chemical composition of the iron-based soft magnetic alloy is such that it contains at least one element selected from niobium, tungsten, tantalum, zirconium, hafnium, titanium and molybdenum with a content of between 2% and 5%.

8. The process as claimed in claim 4, wherein the chemical composition of the iron-based soft magnetic alloy is such that:

$$12\% \leqq Si \leqq 17\%$$

.

9. The process as claimed in claim 8, wherein the chemical composition of the iron-based soft magnetic alloy is such that:

$$0.5\% \leqq Cu \leqq 1.5\%$$

$$5\% \leqq B \leqq 14\%$$

$$15\% \leqq Si+B \leqq 25\%$$

and the content of at least one element selected from niobium, tungsten, tantalum, zirconium, hafnium, titanium and molybdenum is between 2% and 4%.

10. The process as claimed in claim 1, wherein at least one annealing operation is carried out under a magnetic field.

* * * * *